US005988484A

United States Patent [19]

Osborn et al.

[11] Patent Number: 5,988,484

[45] Date of Patent: Nov. 23, 1999

[54] CLAD TUBULAR PRODUCT AND METHOD OF MANUFACTURING SAME

[76] Inventors: Donald Osborn, 8294, Old Post Rd. East, N.Y. 14051; Josef Worringer, Voesch 56 B, D-47906, Kempen, Germany

[21] Appl. No.: 09/045,356

[22] Filed: Mar. 20, 1998

[51] Int. Cl.[6] ..... B23K 20/00; B23K 20/24; B23K 101/06; B21C 37/06; B21C 37/30

[52] U.S. Cl. ..... 228/126; 228/175; 228/234.1; 228/265

[58] Field of Search ..... 228/126, 127, 228/131, 156, 265, 234.1, 175, 262.41

[56] References Cited

U.S. PATENT DOCUMENTS

| | | | |
|---|---|---|---|
| 3,050,613 | 8/1962 | Sheinhartz | 219/50 |
| 3,559,274 | 2/1971 | Aranata | 228/127 |
| 3,918,623 | 11/1975 | Ishiguro et al. | 228/127 |
| 4,620,660 | 11/1986 | Turner . | |
| 4,620,662 | 11/1986 | Driggers | 228/227 |
| 4,744,504 | 5/1988 | Turner . | |
| 4,754,911 | 7/1988 | Turner . | |
| 4,765,529 | 8/1988 | Turner . | |
| 4,790,471 | 12/1988 | Turner . | |
| 4,869,422 | 9/1989 | Turner . | |
| 4,881,679 | 11/1989 | Turner . | |
| 5,000,368 | 3/1991 | Turner . | |

OTHER PUBLICATIONS

Sear, David. "Seamet. The economical clad pipework solution." Stainless Steel World, Jan./Feb. 1997, pp. 22–25.

*Primary Examiner*—Samuel M. Heinrich

*Attorney, Agent, or Firm*—The Bilicki Law Firm, P.C.

[57] ABSTRACT

A method of manufacturing clad tubular product from a hollow carbon steel billet having an inner diameter and a hollow corrosion resistant alloy billet having an outer diameter, comprising the steps of: machining the inner diameter of the hollow carbon billet and the outer diameter of the hollow corrosion resistant alloy billet to result in an interference fit between the two billets at room temperature when the corrosion resistant billow is placed inside the carbon billet; heating the hollow carbon billet in a furnace until the carbon billet reaches a temperature in the range of approximately 400° F. to about 850° F.; inserting the corrosion resistant billet inside of the hollow carbon billet while the carbon billet is at a temperature in the range of approximately 400° F. to about 850° F., and the corrosion resistant alloy billet is at approximately room temperature, thereby forming a composite billet; cooling the composite billet to room temperature; welding the corrosion resistant alloy billet to the carbon billet at one end of the composite billet; preheating the composite billet with a heating element placed within the interior of the corrosion resistant alloy billet to a temperature in the range of approximately 400° F. to about 800° F.; globally heating the preheated composite billet to an extrusion temperature in the range of approximately 1850° F. to about 2350° F.; and, extruding the heated composite billet to produce the clad tubular product; and the product produced by the method.

8 Claims, 5 Drawing Sheets

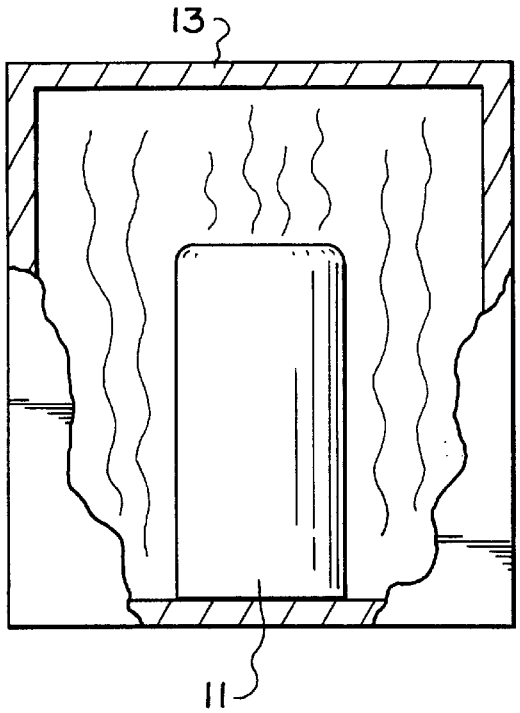
FIG. 4
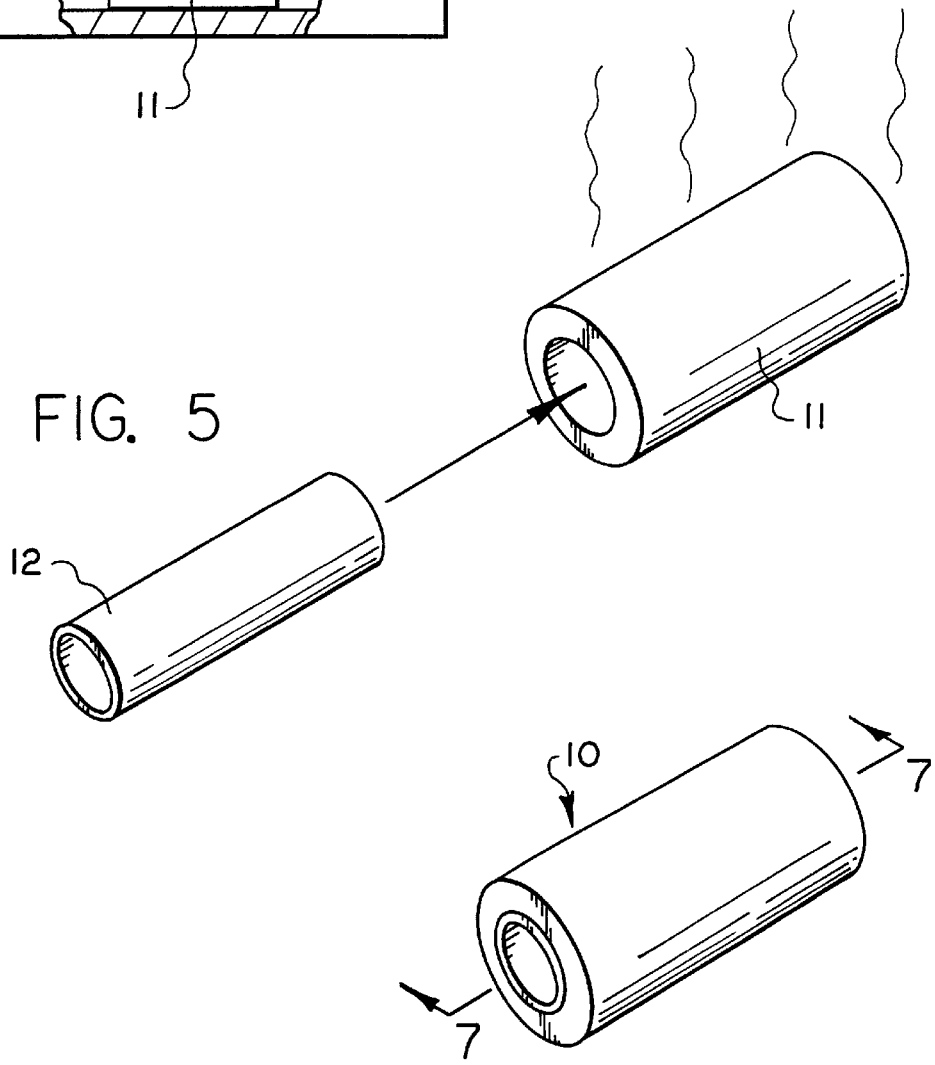
FIG. 5
FIG. 6

CLAD TUBULAR PRODUCT AND METHOD OF MANUFACTURING SAME

FIELD OF THE INVENTION

This invention relates generally to tubular products, and particularly, to a new method of making a clad tubular product and to a new clad tubular product produced by the method.

BACKGROUND OF THE INVENTION

There exists a need in industry for corrosion resistant-clad products, and, particularly, for clad pipes. These products are used in power plants, in processing plants, in downhole and line applications, in geothermal wells and high temperature, sour gas wells.

Clad pipes usually combine the required properties of a more expensive corrosion-resistant alloy (CRA) on the inside with the excellent strength, ductility, weldability and low costs of a carbon steel outer shell or host. The two materials are joined to form a metallic bond. A good metallic bond insures high strength of the clad product and offers optimum corrosion resistance.

Several manufacturing processes are known in the art for the manufacture of clad metal pipes. In one method, roll-clad metal sheets are bent to form a pipe, which is then longitudinally seam welded. However, this process must be carefully monitored and for many applications engineers prefer to limit the number of welds as much as possible. In a second method, known as centrifugal casting, a molten CRA metal melt is cast into a molten steel metal pipe which is mounted on bearings in such a way as to be rotatable about its axis. The molten metal is distributed evenly along the length and across the circumference of the metal pipe during its rotation. In the method of internal-pressure plating, an internal thin-walled pipe, which forms the internal cladding, is inserted accurately to fit into a metal pipe, and, with the application of hydraulic or pneumatic pressure, expanded onto the inner circumferential surface of the host pipe. (See, e.g., German Patent No. 4,406,188).

A more recent technique for manufacture to date has been to use an activator between the component layers. This initiates a liquid state diffusion between the corrosion resistant alloy and the host during extrusion, which is responsible for the metallurgical bond. Such a method is described in U.S. Pat. No. 4,620,660 (Turner). In this patented method, the internal surface of the host is plated with a low melting point bonding metal alloy. A cylindrical cladding member is placed inside the plated cylindrical host, and then circumferentially welded on one end to the host. The other end is then welded to a manifold with an evacuation tube and connected to a vacuum source. The annular space between the cladding member and the host is evacuated to remove water vapor and oxygen and sealed, which promotes diffusion across the interface during extrusion.

A similar method is described in U.S. Pat. No. 4,744,504 (Turner). Similar to the method described in the '660 patent described supra, in this patented method, the internal surface of the host is plated with a low melting point bonding metal alloy. A cylindrical cladding member is placed inside the plated cylindrical host, and then circumferentially welded on one end to the host. The other end is then welded to create a metallic gas reservoir. The annular space between the cladding member and the host is evacuated to remove water vapor and oxygen. The subassembly is heated to about 1650° to about 2200° F. to melt the bonding metal alloy. Finally, the subassembly is hot extruded to metallically bond the cladding member to the cylindrical host by means of liquid interface diffusion bonding. Unfortunately, the billet preparation for this process is fairly complicated due to the requirement for a very precise fit between the CRA and host components and the need to maintain a high level of vacuum between the layers which has to be maintained during heating up to extrusion temperature. The complexity of the method also makes it very expensive to implement. Variations and improvements on the patented Turner methods are further described in U.S. Pat. Nos. 5,000,368; 4,790,471; 4,765,529; 4,754,911; 4,881,679; and 4,869,422.

What is needed, then, is an inexpensive, commercially viable method of producing a high-integrity clad tubular product for a wide range of materials and sizes.

SUMMARY OF THE INVENTION

The present invention broadly comprises a method of manufacturing clad tubular product from a hollow carbon steel billet having an inner diameter and a hollow corrosion resistant alloy billet having an outer diameter, comprising the steps of:

(a) machining the inner diameter of the hollow carbon billet and the outer diameter of the hollow corrosion resistant alloy billet to result in an interference fit between the two billets at room temperature when the corrosion resistant billet is placed inside the carbon billet;

(b) heating the hollow carbon billet in a furnace until the carbon billet reaches a temperature in the range of approximately 400° F. to about 850° F.;

(c) inserting the corrosion resistant billet inside of the hollow carbon billet while the carbon billet is at a temperature in the range of approximately 400° F. to about 850° F., and the corrosion resistant alloy billet is at approximately room temperature, thereby forming a composite billet;

(d) cooling the composite billet to room temperature;

(e) welding the corrosion resistant alloy billet to the carbon billet at one end of the composite billet;

(f) preheating the composite billet with a heating element placed within the interior of the corrosion resistant alloy billet to a temperature in the range of approximately 400° F. to about 800° F.;

(g) globally heating the preheated composite billet to an extrusion temperature in the range of approximately 1850° F. to about 2350° F.; and, extruding the heated composite billet to produce the clad tubular product.

The invention also includes the article of manufacture, i.e., the tubular clad product, produced by the above-described method.

Accordingly, a general object of the invention is to provide a method of inexpensively producing a very high integrity, tubular clad product.

Another object of the invention is to produce a clad product without the need for evacuation of air space between the host and clad member.

These and other objects, advantages and features of the present invention will become readily apparent from the following written description of the invention as shown in the drawings.

BRIEF DESCRIPTION OF THE DRAWINGS

FIG. 4 illustrates the step of preheating the hollow carbon billet in a furnace prior to insertion of the CRA billet;

FIG. 5 is a perspective view that illustrates insertion of the CRA billet into the carbon billet;

FIG. 6 is a perspective view that illustrates the clad product just after the CRA billet has been inserted into the carbon billet;

DETAILED DESCRIPTION OF THE PREFERRED EMBODIMENT

At the outset it should be understood that identical reference numbers on different drawings refer to identical structural elements. Also, it should be appreciated that, although a specific embodiment of the invention is disclosed herein having a host billet and corrosion resistant alloy billet with specific chemical compositions, the method of the invention is not limited to any particular chemical composition for either billet. In fact, the method of the invention will also work with a host billet made of any of the following AISI materials: 1017, 1010 4340, 4130, X-50, X-60, X-65, X-70 in combination with one of the following corrosion resistant alloys (UNS numbers): S30400, S30403, S30409, S31600, S31603, S31609, S31700, S31703, S32100, S32109, S34700, S34709, N08810, N08811, N08825, S31803, S31500, N08925. This is not an exhaustive list, and other materials may also be used satisfactorily in practicing the method of the invention.

Figure 1:
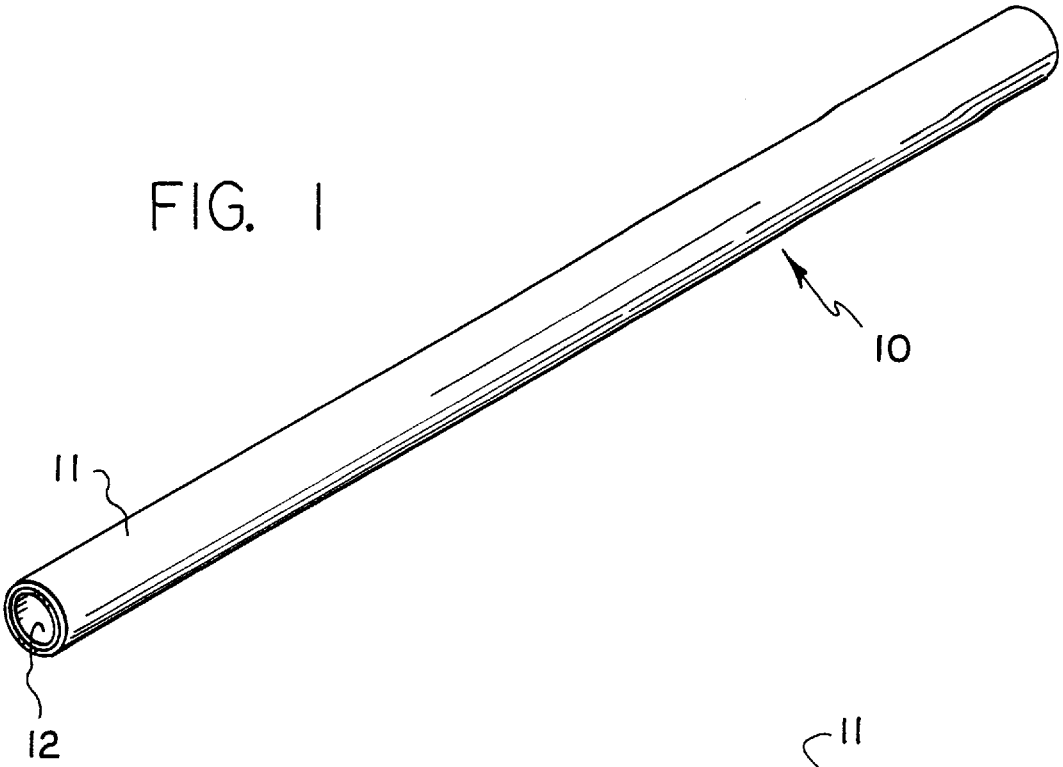
FIG. 1 is a perspective view of the clad tubular product of the invention.
Figure 2:
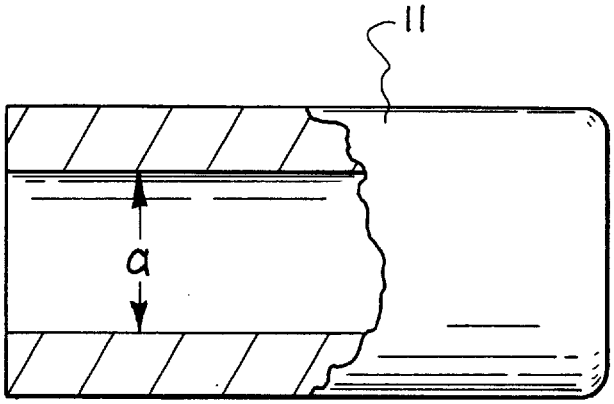
FIG. 2 is a partial cross-sectional view of the hollow carbon billet of the invention.
Figure 3:
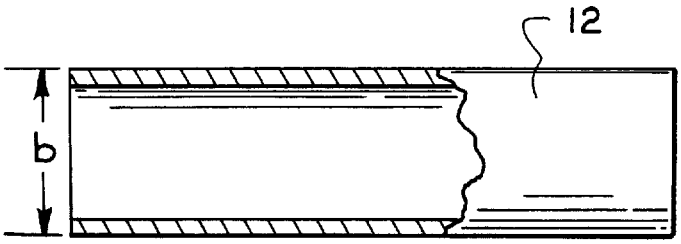
FIG. 3 is a partial cross-sectional view of the hollow corrosion resistant alloy (hereinafter CRA) of the invention.

The method of the invention begins with a hollow carbon steel host billet 11 (hereinafter referred to as "carbon billet"), shown in fragmentary cross-sectional view in FIG. 2, and a corrosion resistant alloy (CRA) hollow billet 12, shown in fragmentary cross-sectional view in FIG. 3. In a preferred embodiment, carbon billet 11 is made of X-52 carbon steel, and is cylindrically shaped; and CRA billet 12 is made of UNS N08825, and is also cylindrically shaped. At the outset of the process, inner diameter a of billet 11 is slightly smaller than outer diameter b of billet 12, so as to create an interference fit when the CRA billet is inserted into the carbon billet. For example, dimension a may be 9.59" and dimension b may be 9.62". Prior to commencing the method, the respective billets are formed to substantially equal lengths.

Assuming the billets are machined to appropriate dimensions, the first step of the method is illustrated in FIG. 4. Carbon billet 11 is placed in an upright orientation in furnace 13 and heated to a temperature in the range of approximately 400° to 850° F. It should be noted that this temperature range is approximate and may vary depending upon the composition and dimensions of the carbon billet. The object in this step is simply to expand the carbon billet in order that the CRA billet may be inserted therein.

Figure 7:
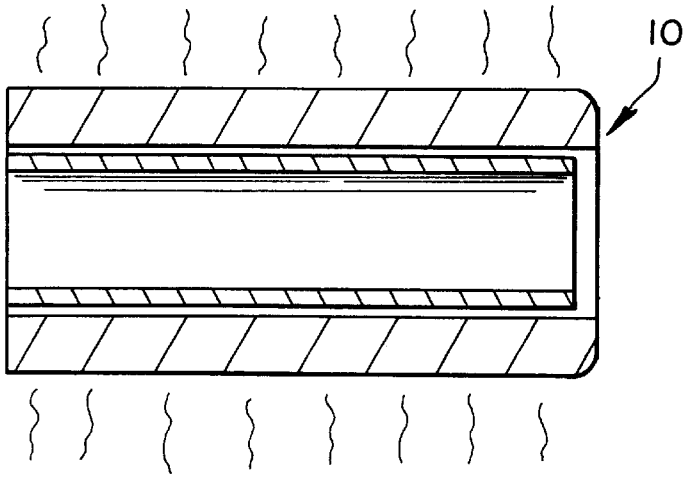
FIG. 7 is a cross-sectional view taken generally along plane 7—7 in FIG. 6.

Once the carbon host billet is heated, the CRA billet, which is at room temperature, is inserted inside the carbon host (which is still at a temperature of 400° to 850° F.), as illustrated in FIG. 5. The composite product 10 is shown in perspective view in FIG. 6, and in cross-sectional view in FIG. 7, which is a view taken generally along plane 7—7 in FIG. 6. As shown in FIG. 7, when the carbon host billet is heated, it expands, which permits the CRA billet to be inserted therein. FIG. 7 clearly illustrates that the inner diameter of the carbon host billet is larger than the outer diameter of the CRA billet when the carbon billet is heated and the CRA billet is at room temperature.

Figure 8:
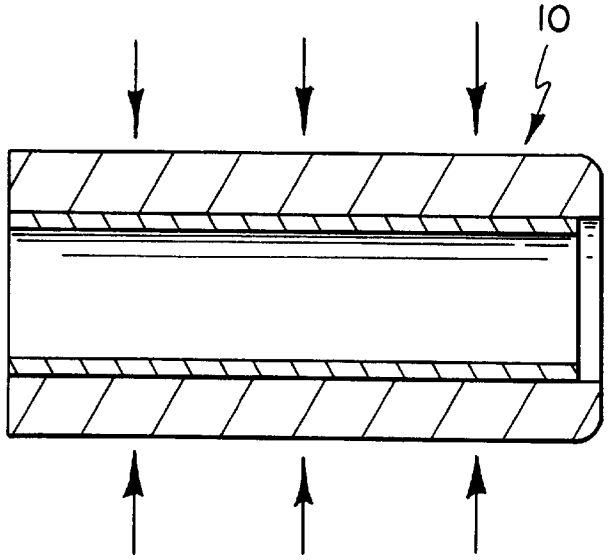
FIG. 8 is a cross-sectional view similar to that of FIG. 7, and intended to show contraction of the carbon billet upon the CRA billet as the carbon billet cools.
Figure 9:
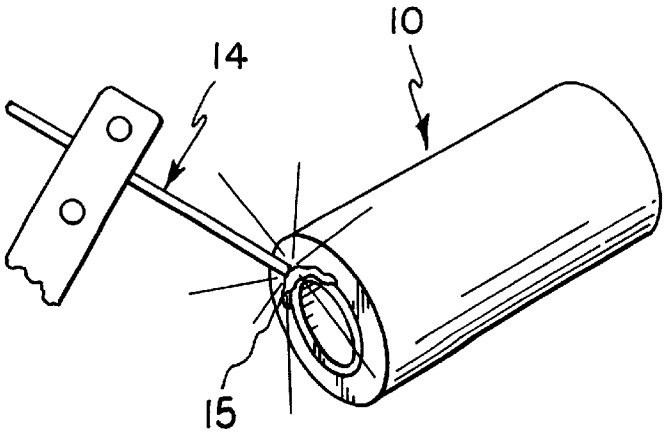
FIG. 9 is a perspective view of the invention shown in FIG. 8, illustrating welding of the CRA billet to the carbon billet on one end.

As the carbon host cools, the billet contracts about the CRA billet, and creates an interference fit as shown in cross-sectional view in FIG. 8. Once completely cooled, welding instrument 14 is used to make a weldment 15, which secures one end of the carbon host billet to one end of the CRA billet.

Figure 10:
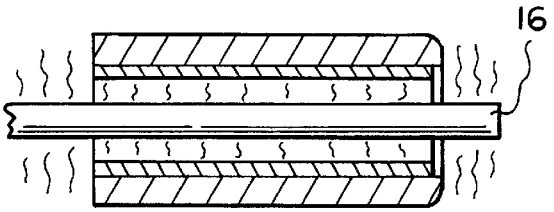
FIGS. 10–15 illustrate internal heating, global heating, extrusion which produces a true metallurgical bond, and the resulting clad product.

A key step in the process is illustrated in FIG. 10. In this step, a heat source element 16 (such as a Glo-bar element) is inserted inside the bore of the CRA billet, and the composite billet is preheated to a temperature in the range of approximately 400° F. to about 800° F. This step is important because it causes the inner CRA material layer to expand into the host to maintain integrity of the composite billet during global heating. Although a Glo-bar device was used to internally heat the composite billet in a preferred embodiment, it should be appreciated that the internal heating can be accomplished in a number of ways, including, for example, heating by a as-fired tubular element.

Figure 12:
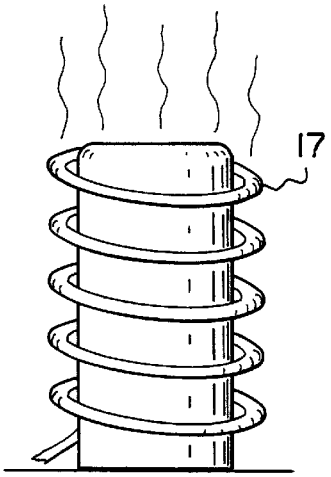
Figure 11:
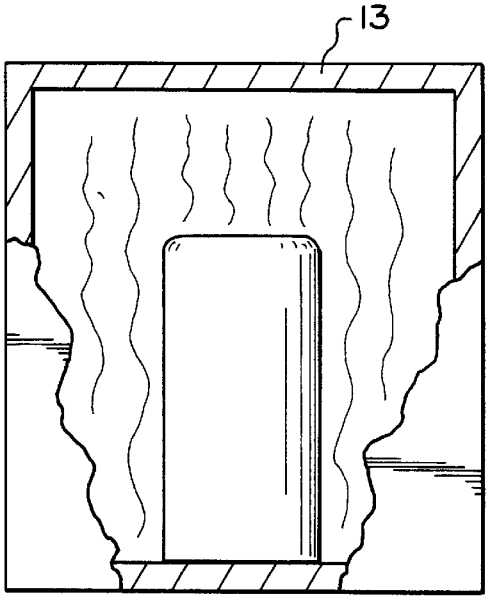

While the composite billet is at this preheat temperature, it is then subjected to a global heating to bring the composite billet to the extrusion temperature. The global heating may be accomplished in a number of ways. In FIG. 11, for example, the composite product is placed in furnace 13 and heated to an extrusion temperature in the range of approximately 1850° to about 2350° F. (Although the billet is shown in an upright orientation in the furnace, this is not critical, i.e., the billet may be placed horizontally, etc.) In FIG. 12, the composite product is shown being globally heated by an induction heating coil.

Figure 13:
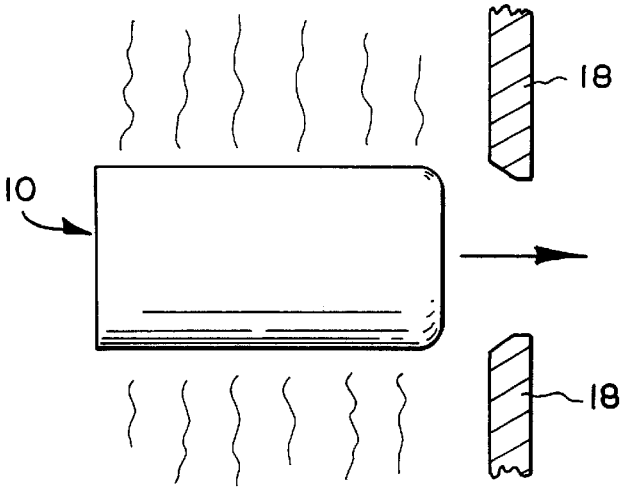
Figure 14:
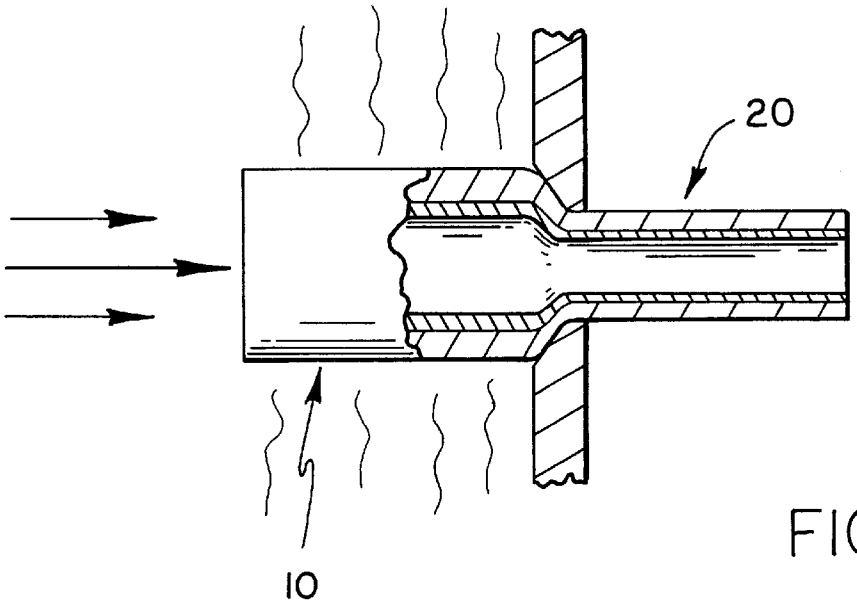
Figure 15:
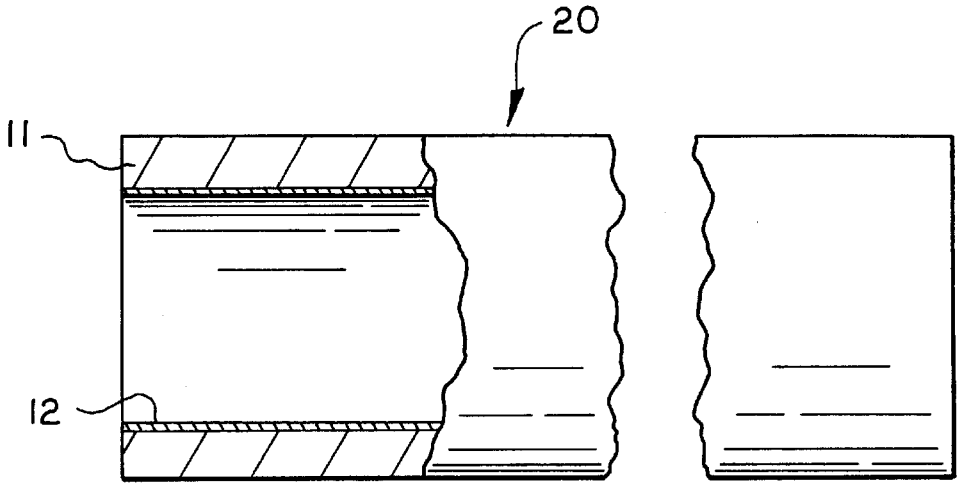

Once heated to the extrusion temperature, composite billet 10 is pushed through extrusion elements 18 as shown in FIGS. 13 and 14. Under the high temperature and pressure associated with the extrusion process, diffusion occurs across the interface of the two materials to produce a true metallurgical bond. The resulting clad product 20 is shown in FIGS. 14 and 15.

EXAMPLE

The inventors engineered a billet size required to produce a 6.625" outer diameter×6" inner diameter 1017 carbon steel host pipe and a 3 millimeter 316 L clad corrosion resistant alloy (CRA) inner diameter layer. The necessary raw material was procured and prepared into 36" long billets. The billets were prepared using the method described above. The initial furnace heating of the host billet was done in a gas-fired furnace preheated to approximately 1600° F. After the composite billet was formed, it was internally heated (by a Glo-bar heating element inserted inside the composite) to a temperature in the range of approximately 400° F. to about 800° F. The composite was then transferred to induction coils for final heating to approximately 2150° F. The composite was then extruded using standard extrusion practices. The resultant clad product was of extremely good quality from the standpoint of dimensional tolerances, surface finish and concentricity of the two component parts. In addition, the demonstration of metallurgical bonding was confirmed by the ability of the extruded pipe to withstand a standard API 5LD flattening test with no separation of the two components.

Thus, it is seen that the objects of the invention are efficiently obtained. It should be apparent to those having ordinary skill in the art that modifications and changes can be made in the method of the invention without departing from the spirit and scope of the appended claims.

What I claim is:

1. A method of manufacturing a composite tubular product from a hollow first billet made of a first material and having an inner diameter, and a hollow second billet made of a second dissimilar material and having an outer diameter, comprising:

(a) machining said inner diameter of said hollow first billet and said outer diameter of said hollow second billet to result in an interference fit between the two billets at room temperature when said second billet is placed inside of said first billet;

(b) heating said first billet until said first billet inner diameter expands to be larger than the outer diameter of said second billet;

(c) inserting said second billet inside of said first billet while said first billet is at a higher temperature than said second billet, thereby forming a composite billet;

(d) cooling said composite billet;

(e) securing said second billet to said first billet at one end of said composite billet;

(f) preheating said composite billet to a first temperature from a heating element positioned within said second billet;

(g) globally heating said composite billet to a temperature suitable for extrusion; and, (h) extruding said globally heated composite billet to produce said composite tubular product.

2. A method as recited in claim 1 wherein said first billet is made of carbon steel.

3. A method as recited in claim 1 wherein said second billet is made of a corrosion-resistant alloy.

4. A method as recited in claim 2 wherein said first billet is made of AISI 1017 carbon steel.

5. A method as recited in claim 3 wherein said second billet is made of alloy UNS 08825.

6. A method as recited in claim 1 wherein said preheating is done by a heating element, which is placed longitudinally within a through-bore of said second billet.

7. A method as recited in claim 6 wherein said preheating causes the material of said second hollow billet to expand into the host to maintain integrity of the composite billet during global heating.

8. A method of manufacturing clad tubular product from a hollow carbon billet having an inner diameter and a hollow corrosion resistant alloy billet having an outer diameter, comprising:

(a) machining said inner diameter of said hollow carbon billet and said outer diameter of said hollow corrosion resistant alloy billet to result in an interference fit between the two billets at room temperature when said corrosion resistant billet is placed inside said carbon billet;

(b) heating said hollow carbon billet in a furnace until said carbon billet reaches a temperature in the range of approximately 400° F. to about 850° F.;

(c) inserting said corrosion resistant billet inside of said hollow carbon billet while said carbon billet is at a temperature in the range of approximately 400° F. to about 850° F., and said corrosion resistant alloy billet is at approximately room temperature, thereby forming a composite billet;

(d) cooling said composite billet to room temperature;

(e) welding said corrosion resistant alloy billet to said carbon billet at one end of said composite billet;

(f) preheating said composite billet with a heating element placed within the interior of said corrosion resistant alloy billet to a temperature in the range of approximately 400° F. to about 800° F.;

(g) globally heating said preheated composite billet to an extrusion temperature in the range of approximately 1850° F. to about 2350° F.; and, (h) extruding said heated composite billet to produce said clad tubular product.

* * * * *